US009978355B2

(12) United States Patent
Every et al.

(10) Patent No.: US 9,978,355 B2
(45) **Date of Patent: *May 22, 2018**

(54) SYSTEM AND METHOD FOR ACOUSTIC MANAGEMENT

(71) Applicant: 2236008 Ontario Inc., Waterloo (CA)

(72) Inventors: Mark Robert Every, Surrey (CA); Phillip Alan Hetherington, Port Moody (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/701,188

(22) Filed: Sep. 11, 2017

(65) Prior Publication Data

US 2017/0372689 A1 Dec. 28, 2017

Related U.S. Application Data

(63) Continuation of application No. 14/794,160, filed on Jul. 8, 2015, now Pat. No. 9,767,784.

(Continued)

(51) Int. Cl.
*G10K 11/175* (2006.01)
*G10L 21/02* (2013.01)

(Continued)

(52) U.S. Cl.
CPC ..... *G10K 11/175* (2013.01); *G10L 21/02* (2013.01); *G10L 25/78* (2013.01); *G10L 2021/02082* (2013.01)

(58) Field of Classification Search
None
See application file for complete search history.

(56) References Cited

U.S. PATENT DOCUMENTS 5,920,834 A * 7/1999 Sih ..... H04B 3/23 379/406.06
6,522,746 B1 * 2/2003 Marchok ..... G10L 15/30 379/201.01

(Continued)

FOREIGN PATENT DOCUMENTS

EP 1901282 A2 * 3/2008 ..... B60N 2/002
EP 2876905 A1 * 5/2015 ..... H04M 3/568

OTHER PUBLICATIONS

European Search Report for corresponding European Application No. 15176119.4 dated Sep. 10, 2015, 7 pages.*

(Continued)

*Primary Examiner* — Paul Huber
(74) *Attorney, Agent, or Firm* — Brinks Gilson & Lione

(57) ABSTRACT

A system and method for acoustic management that includes improving the sound quality of two or more audio processing modules in an acoustic environment may receive first control parameters from a first audio processing module. Receiving second control parameters from a second audio processing module. An audio processing interaction may be derived between with the first audio processing module and the second audio processing module determined from the first control parameters and the second control parameters. The first control parameters and the second control parameters may be modified responsive to the derived audio processing interaction. The modified first control parameters may be sent to the first audio processing module and the modified second control parameters may be sent to the second audio processing module where the first audio processing module and the second audio processing module may perform any one or more of processing audio captured from an acoustic environment and processing audio to be reproduced in the acoustic environment.

20 Claims, 8 Drawing Sheets

Related U.S. Application Data

(60) Provisional application No. 62/022,361, filed on Jul. 9, 2014.

(51) Int. Cl.
*G10L 25/78* (2013.01)
*G10L 21/0208* (2013.01)

(56) References Cited

U.S. PATENT DOCUMENTS

| | | | | |
|---|---|---|---|---|
| 9,392,365 | B1 * | 7/2016 | Yang | H04M 9/082 |
| 2004/0059571 | A1 * | 3/2004 | Ohtomo | H03G 3/341 704/226 |
| 2009/0016541 | A1 | 1/2009 | Goldstein et al. | |
| 2009/0089054 | A1 * | 4/2009 | Wang | H04M 9/082 704/233 |
| 2013/0260692 | A1 * | 10/2013 | Hera | H04M 1/6083 455/63.1 |
| 2015/0281853 | A1 * | 10/2015 | Eisner | H04R 25/505 381/312 |

OTHER PUBLICATIONS

Examination Report dated Dec. 22, 2017 for European Application No. 15176119.4, 7 pages.

* cited by examiner

SYSTEM AND METHOD FOR ACOUSTIC MANAGEMENT

CROSS-REFERENCE TO RELATED APPLICATIONS

This application is a continuation of Ser. No. 14/794,160, now U.S. Pat. No. 9,767,784, which claims priority from U.S. Provisional Patent Application Ser. No. 62/022,361, filed Jul. 9, 2014, the entirety of both of which are incorporated herein by reference.

BACKGROUND

Technical Field

The present disclosure relates to the field of processing audio signals. In particular, to a system and method for acoustic management.

Related Art

Audio and voice processing functionality in modern vehicles is becoming increasingly rich and diverse. Some recent trends include adoption of voice as a common modality for user interaction, improved quality of voice communications to and from the vehicle over cellular networks and even between occupants of the same vehicle, use of acoustic technologies to improve the sound of the engine and reduce noise, increased attention to pedestrian safety issues with adoption of legislation on minimum sound levels exterior to the vehicle, and increasing customization of infotainment systems for multiple seating positions within the vehicle. The immediate beneficiaries of these technologies are the driver, passengers, pedestrians, far-end mobile telephony talkers and infotainment service providers using voice as an interface. Individually, each of the audio and voice processing functions may resolve a specific audible issue but when operated simultaneously the audio and voice processing functions may compete or interfere with each other resulting in adverse side effects due to unintentional interactions between different concurrent functionality. In addition, some of these functions may be provided using separately implemented systems resulting in undesirable duplication of subfunctions, increased overall bill-of-material cost, increased weight and increased power consumption.

BRIEF DESCRIPTION OF DRAWINGS

The system and method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Other systems, methods, features and advantages will be, or will become, apparent to one with skill in the art upon examination of the following figures and detailed description. It is intended that all such additional systems, methods, features and advantages be included with this description and be protected by the following claims.

DETAILED DESCRIPTION

Figure 1:
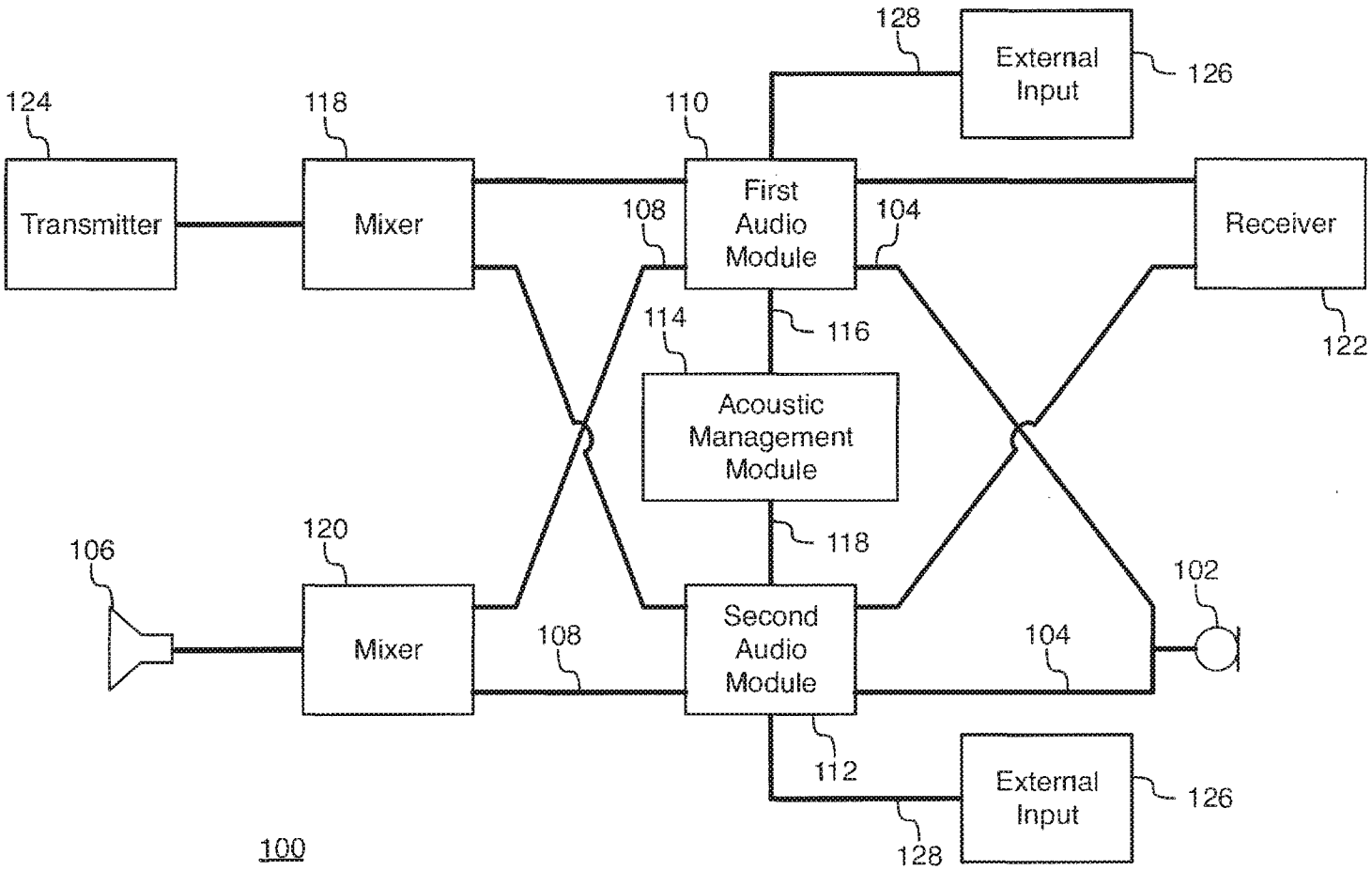
FIG. 1 is a schematic representation of a system for improving the sound quality of two or more audio processing modules in an acoustic environment.

A system and method for acoustic management that may, for example, improve the sound quality of two or more audio processing modules in an acoustic environment. The system and method may receive first control parameters from a first audio processing module. The system and method may further receive second control parameters from a second audio processing module. An audio processing interaction may be derived between with the first audio processing module and the second audio processing module determined from the first control parameters and the second control parameters. The first control parameters and the second control parameters may be modified responsive to the derived audio processing interaction. The modified first control parameters may be sent to the first audio processing module and the modified second control parameters may be sent to the second audio processing module. Each of the first audio processing module and the second audio processing module may perform any one or more of processing audio captured from an acoustic environment and processing audio to be reproduced in the acoustic environment responsive to the modified first control parameters and the modified second control parameters respectively.

Audio and voice processing functionality in modern vehicles is becoming increasingly rich and diverse. Some recent trends include adoption of voice as a common modality for user interaction, improved quality of voice communications to and from the vehicle over cellular networks and even between occupants of the same vehicle, use of acoustic technologies to improve the sound of the engine and reduce noise, increased attention to pedestrian safety issues with adoption of legislation on minimum sound levels exterior to the vehicle, and increasing customization of infotainment systems for multiple seating positions within the vehicle. The immediate beneficiaries of these technologies are the driver, passengers, pedestrians, far-end mobile telephony talkers and infotainment service providers using voice as an interface. With these trends there may be a greater need for effective management of the acoustics of the vehicle to ensure that these diverse technologies work optimally together, rather than potentially compete or interfere with each other and result in adverse side effects due to unintentional interactions between different concurrent functionalities. In addition, when some of these functions are provided using separately implemented systems this may result in undesirable duplication of sub-functions, increased overall bill-of-material cost, increased weight and increased power consumption.

The following description describes the management of the acoustic environment using an acoustic management module, or audio management module, when multiple voice and audio processing functions, or audio processing functions, are implemented within a vehicle. The acoustic management module may manage different acoustic environments, for example, a room with a conference phone where two or more audio processing functions may be concurrently operated. Some audio processing functions are specified below, although the list is not exhaustive and other functionalities may be included without loss of generality.

Voice processing (VP) functions may include, for example, any one or more of noise reduction, echo cancellation, adaptive equalization, adaptive gain and various other speech enhancement techniques for either hands-free (HF) communications or as a preprocessor for voice recognition (VR). Active noise control (ANC) functions may utilize one or more loudspeakers, or audio transducers, within the vehicle to reduce the loudness of engine tones or low-frequency road noise inside the vehicle. Engine sound enhancement (ESE) functions may utilize loudspeakers within the vehicle to add synthetic engine sound into the cabin. An automobile manufacturer may use ESE to create a brand around the sound of the vehicle to make driving more enjoyable and provide audio feedback on engine status. ESE may also be utilized to create or enhance the external sound of the vehicle using external audio transducers. External pedestrian alert (XPA) functions may utilize external transducers to provide audio feedback to the exterior of the vehicle for safety, e.g. pedestrian warning for approaching electric, hybrid and conventional combustion engine vehicles. The infotainment system may provide playback functionality for audio or voice signals including any one or more of music, radio, text-to-speech (TTS), VR and navigation prompts. Noise level compensation (NLC) functions may adjust the volume level and/or equalize the audio, or music, from the infotainment system based on background noise level in the vehicle as measured at one or more microphones. In-car-communications (ICC) functions may utilize audio transducers and microphones within the vehicle to increase speech audibility and ease communication between vehicle occupants. Chimes or warning functions may be introduced from the vehicle including, for example, seatbelt unbuckled warning, door open warning and audible turn signal indications. As communication systems between vehicles and other external devices evolves, additional audible feedback to the driver may be introduced including, for example, warning sounds for approaching emergency vehicles, awareness of nearby vehicles, and poor road conditions.

An acoustics management module may manage several different audio processing modules, as well as the physical and acoustic environment of the vehicle, and applications that provides audio content. The physical environment may contain physical components including microphones, loudspeakers, accelerometers, headphones, and other sensors. The acoustics management module may also manage the interactions between physical components, such as the echo paths between loudspeakers and microphones inside the vehicle where feedback may occur. The physical environment may also comprise separate zones within the vehicle, for example, listening over headphones in the second row while audio may be broadcast to the driver over loudspeakers.

FIG. 1 is a schematic representation of a system for improving the sound quality of two or more audio processing modules in an acoustic environment 100. A first audio module 110 may receive one or more captured audio signals 104 from one or more microphones 102 located in an acoustic environment. The first audio module 110 may process, or modify, one or more of the captured audio signals 104 producing one or more processed audio signals 108. The processed audio signals 108 may be reproduced in the acoustic environment utilizing one or more audio transducers 106. The audio to be produced utilizing the one or more audio transducers 106 may be received by the first audio module 110 as a reference signal, or feedback path. The one or more microphones 102 may be located, for example, at different spatial location within the acoustic environment. In an alternative example, the one or more microphones 102 may be arranged in a beam-forming configuration. The one or more audio transducers 106 may be arranged, for example, in a mono, stereo or multi-channel configuration in the acoustic environment. The one or more microphones 102 and the one or more audio transducers 106 may be located in the same acoustic environment. An acoustic environment associated with an automotive vehicle may be, for example, inside the vehicle, external to the vehicle or both. The first audio processing module 110 may receive one or more audio signals from a receiver 122. The receiver 122 may be, for example, a radio frequency receiver in a mobile phone. The audio signals output from the receiver associated with the mobile phone may comprise speech of a far-end talker. The first audio module 110 may send one or more audio signals to a transmitter 124. The transmitter 124 may be, for example, a radio frequency transmitter in a mobile phone where the audio signals may be transmitted to a far-end listener. The first audio module 110 may receive one or more external control signals 128 from one or more external inputs 126. The one or more external control signals 128 associated with a vehicle may include, for example, engine speed and acceleration.

The first audio module 110 may send or receive one or more first control parameters, or first control parameters 116. The first control parameters 116 may include any one or more of parameters that control the audio processing functionality of the first audio module 110, non-audio control input/output (I/O), and intermediate audio processing metadata. Parameters that control the audio processing functionality of the first audio module 110 may include, for example, gain values of an audio equalizer. The non-audio control I/O may include, for example, an indication of voice activity from a voice activity detector and an on/off control. The intermediate audio processing metadata may include, for example, the amplitude and frequency of the tones being generated in an active noise control module.

The first audio module 110 may provide audio processing functionality described above including, for example, echo cancellation, active noise control, engine sound enhancement, in-car communications, voice activity detection, and audio equalization. The first audio module 110 may receive or produce audio signals from any one or more of the microphones 102, the receiver 122, the one or more audio transducers 106 and the transmitter 124. For example, active noise control may receive one or more captured audio signals 104 and produce one or more processed audio signals 108. External pedestrian alert may produce one or more processed audio signals 108. Acoustic echo cancellation may receive audio from any one or more of the microphones 102, the receiver 122, and audio to be reproduced in the one or more audio transducers 106, or a feedback path. The acoustic echo cancellation may produce an audio signal and send the audio output to the transmitter 124. Voice activity detection may receive audio signals from any one or more of the microphones 102.

A second audio module 112 may send and receive similar inputs and outputs as those sent and received from the first audio module 110. The second audio module 112 may receive or produce audio signals from any one or more of the microphones 102, the receiver 122, the one or more audio transducers 106 and the transmitter 124. The second audio module 112 may send or receive one or more second control parameters, or second control parameters 118 similar in function to the first control parameters 116. The second audio module 112 may receive one or more external control signals 128 from one or more external inputs 126. The first audio processing module 110 and the second audio processing module 112 performs any one or more of processing audio captured 104 from the acoustic environment and processing audio to be reproduced 108 in the acoustic environment.

A mixer 120 may receive processed audio signals 108 from one or more of the first audio module 110 and the second audio module 112. The mixer 120 may combine two or more processed audio signals 108 where the combined audio signals are reproduced using the one or more audio transducers 106. The combined audio signals may be sent to the first audio module 110 and the second audio module 112. For example, the combined audio signal may be utilized by an acoustic echo canceller as a reference audio signal.

An acoustic management module 114 may receive first control parameters 116 from the first audio processing module 110 and receive second control parameters 118 from the second audio processing module 112. The acoustic management module 114 may derive an audio processing interaction between with the first audio processing module 110 and the second audio processing module 112 determined from the first control parameters 116 and the second control parameters 118. The audio processing interaction may be determined to cause adverse side effects due to unintentional interactions between the first audio processing module 110 and the second audio processing module 112. For example, operating active noise control concurrently with a hand free phone call that utilizes an acoustic echo canceller may cause undesirable audible artifacts. The active noise control may be designed to reduce the effects of engine noise up to 150 Hz. A full bandwidth phone call may operate at frequencies above 100 Hz. The active noise control function may process one or more of the captured audio signals 104. The one or more captured audio signal 104 may contain voice signals below 700 Hz output from the hands free phone call. The voice signals may interfere with the active noise control function by, for example, causing the active noise control function to miscalculate the engine noise. The miscalculation may increase the audible engine noise whenever the one or more microphones 102 capture a voice signal.

The acoustic management module 114 may modify the first control parameters 116 and the second control parameters 118 responsive to the derived audio processing interaction. The acoustic management module 114 may send the modified first control parameters 116 to the first audio processing module 110 and the modified second control parameters 118 to the second audio processing module 112. For example, the acoustic echo canceller may include a voice activity detector that may send an indication that a voice may be detected as a control parameter to the acoustic management module 114. The acoustic management module 114 may receive further information from the first control parameters 116 and the second control parameters 118 where the acoustic management module 114 determines that the acoustic echo canceller and the active noise control function may be processing audio in an overlapping frequency band. The acoustic management module 114 may determine that the voice activity may cause an audio interaction that may interfere with the active noise control. The acoustic management module 114 may modify the control parameters associated with the active noise control and send them back to the active noise control. The modified control parameters may indicate, for example, a voice signal has been detected and the voice signal may be operating in a same frequency range. The active noise control may respond by, for example, ignoring one or more of the captured audio signals 104 when voice has been detected, ignoring one or more of the captured audio signals 104 in the overlapping frequency range or any other method that may prevent a potentially undesirable audio interaction. In one alternative, the acoustic management module 114 may send modified control parameters to the active noise control that may instruct the active noise control to respond by, for example, ignoring one or more of the captured audio signals 104 when voice has been detected, ignoring one or more of the captured audio signals 104 in the overlapping frequency range or any other method that may prevent a potentially undesirable audio interaction.

Figure 2:
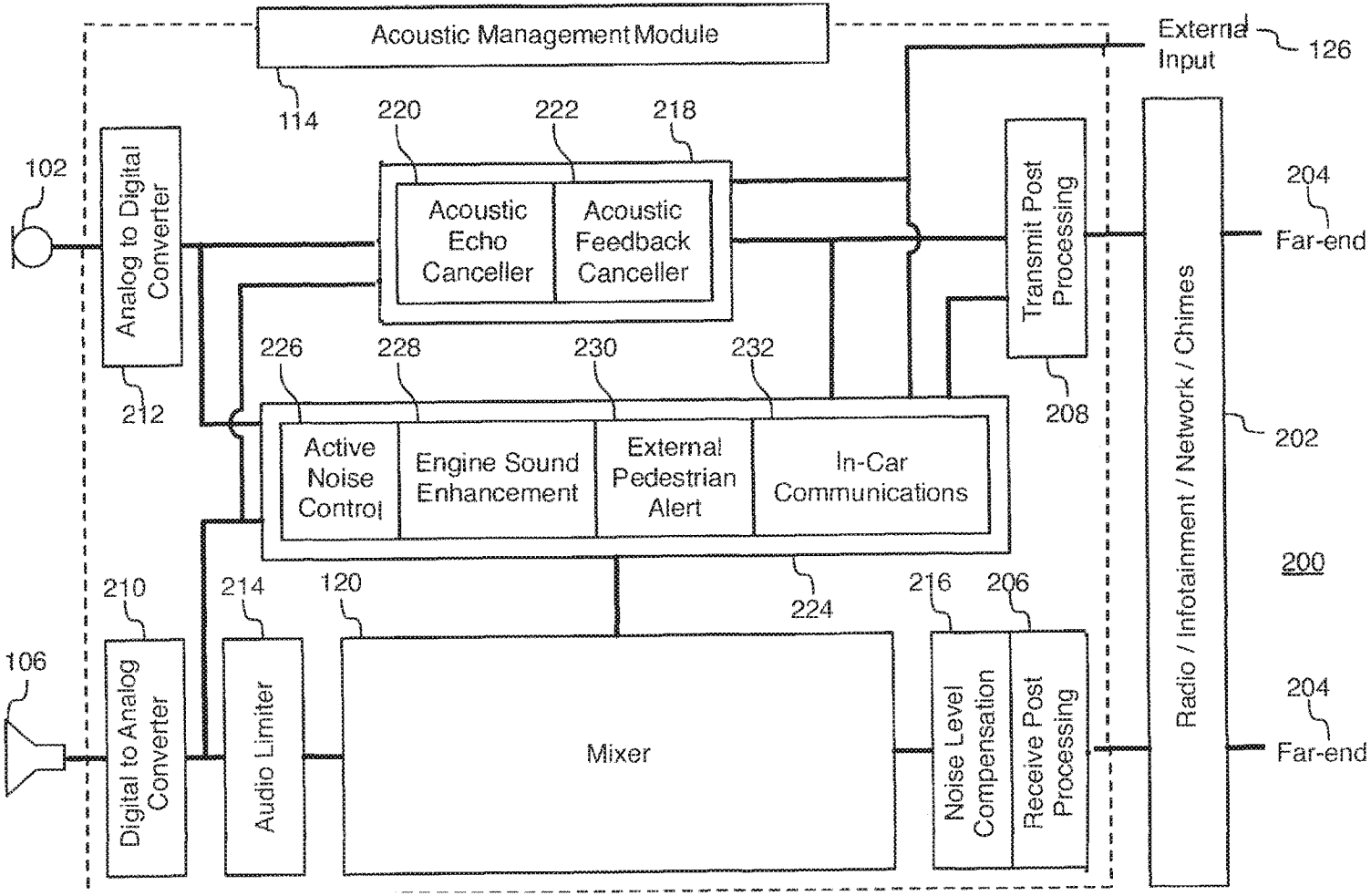
FIG. 2 is a further schematic representation of a system for improving the sound quality of two or more audio processing modules in an acoustic environment.

FIG. 2 is a further schematic representation of a system for improving the sound quality of two or more audio processing modules in an acoustic environment 200. The system 200 is an example audio system configuration for use in a vehicle. The acoustics management module 114 may manage two or more audio processing modules, and may be responsible for ensuring that the audio processing modules act in a mutually compatible manner in accordance with the acoustic environment. Example audio processing modules shown in FIG. 2 may include, for example, an acoustic echo canceller (AEC) 220, an acoustic feedback canceller (AFC) 222, active noise control (ANC) 226, engine sound enhancement (ESE) 228, external pedestrian alert (XPA) 230, in-car communications (ICC) 232, transmit post processing 208, receive post processing 206, noise level compensation (NLC) 216, mixer 120, audio limiter 214, a digital to analog converter (DAC) 210 and an analog to digital converter (ADC) 212. Each of the audio processing modules may communicate control parameters, for example first control parameters 116 and second control parameters 118, with the acoustic management module 114. Communication of the control parameters between the audio processing modules and the acoustic management module 114 are not shown in FIG. 2. The acoustic echo canceller module 220 and the acoustic feedback canceller module 222 may be grouped into a far-end audio processing module 218. The active noise control module 226, engine sound enhancement module 228, external pedestrian alert module 230 and in-car communications module 232 may be grouped into a near-end audio processing module 224.

The example vehicle system 200 may include one or more microphones 102, one or more audio transducers 106 and one or more external inputs 126. Additional external audio signals from an audio content provision layer 202 may be sent and received from an AM/FM/Digital radio, infotainment unit, vehicle chimes and a network. Far-end 204 communications may utilize the transmitter 124 and the receiver 122 associated with the network, now shown in FIG. 2. In one example, multiple of the audio processing modules within the system 200 may be powered whenever the vehicle is operating, whereas the external audio signals in the audio content provision layer 202 may be intermittent, for example, only when the radio unit is operating.

The audio content provision layer 202 may provide audio content that is intended to be reproduced using one or more audio transducers 106 in the cabin and may receive audio from the cabin that can be used to access services, such as voice recognition or be sent to a far-end 204 listener. The audio content provision layer 202 may consist of many different content provision sources that each may have some or no knowledge of the acoustic environment of the vehicle. For example, streaming of multi-media content stored locally or over a network, text to speech (TTS) services for navigation, playback of chime or safety signals, hands-free calling, and cloud based services using voice recognition. Other content provision sources may be added without requiring any change to the interface to the acoustic management module 114. The audio content provision layer 202 or the external input 126 may also supply vehicle diagnostics from a controller area network (CAN) bus to audio processing modules managed by the acoustic management module 114. For example, the CAN bus may be used to provide any one or more of revolutions per minute (RPM) (a.k.a. engine speed), vehicle speed, throttle and engine load to the ESE module 228 and the ANC module 226, and vehicle speed to the NLC module 216.

The acoustic management module 114 may manage two main audio signal paths where one path processes the one or more captured audio signals 104 from the one or more microphones 102, or microphone signal path, and one path that creates processed audio signals 108 to be reproduced using the one or more audio transducers 106, or audio transducer signal path. Each audio path in FIG. 2 may comprise one or more channels of audio. In the microphone signal path, the processing stages may be, for example, sequentially ordered as the ADC module 212, adaptive echo cancellation module 220 and/or the adaptive feedback cancellation module 222, and the transmit post processing module 208 where the transmit post processing module 208 may include any one or more of noise reduction, beam forming, adaptive gain control, fixed or adaptive equalization, limiting and compression. The AEC module 220 and the AFC module 222 may be grouped together as a logical unit, or far-end processing modules 218, since they share the function of estimating the echo paths and it may therefore be advantageous to share information and resources between the two modules, even though their applications and requirements may differ somewhat.

The audio transducer signal path consists mainly of inputs from the audio content provision layer 202, the receive post processing module 206, the noise level compensation module 216, inputs from the near-end audio processing module 224, or acoustics modules, the mixer 120, the audio limiter 214 and the DAC 210. The mixer 120 may combine two or more processed audio signals 108 where the combined audio signals are reproduced using the one or more audio transducers 106. The combined audio signals are provided to the AEC 220, AFC 222 and ANC 226 modules as a reference path, or feedback path, for calculating the echo paths. The acoustics modules may receive the one or more captured audio signals 104, or microphone signals, (primarily for the ANC module 226), and one or both of the echo cancelled microphone signals and noise reduced microphone signals (primarily for the ICC module 232). The mixer 120 may allow each input audio signal to be routed independently to each of the one or more audio transducers 106, or headphones, within the vehicle or external to the vehicle. The mixer 120 may incorporate a tunable gain and an equalization stage for each channel of audio. The mixer 120 may also provide tuning capabilities such as volume, panning or fading that may be exposed to a user.

In general, control parameters referred to above as first control parameters 116 and second control parameters 118 may be communicated between each of the audio processing modules and the acoustic management module 114. The transmit post processing module 208 may create control parameters, for example, a near-end noise estimate that may be used by the receive post processing 206 and NLC 216 modules. The AEC 220 and AFC 222 modules may communicate echo path, echo activity and level information with the ANC 226, ICC 232 and transmit post processing 208 modules.

The acoustic management module 114 may share computational resources in a manner that may be more favorable than implementing individual functionalities independently. Complexity may be reduced by sharing common computations allowing for greater functionality to be implemented at a lower cost on an embedded system with limited computational speed or memory resources. Shared computations may include, for example, FFTs of microphone signals, echo path estimates, noise estimates and other derived quantities. Latency reductions may also be achieved by sharing audio buffers between audio processing modules via the acoustic management module 114.

Each of the audio processing modules and the acoustic management module 114 may execute on one or more independent hardware platforms, embedded system, application processors or digital signal processors (DSP). For example, each of the audio processing modules and the acoustic management module 114 represented in FIG. 2 may all execute on a single application processor. In an alternative example, the ANC module 226 may be a separate independent system that communicates control parameters to the acoustic management module 114 executing on a multicore applications processing with the other shown audio processing modules. In another alternative example, audio processing modules that benefit from low latency including, for example, the ANC module 226 and the ICC module 232, may execute on a DSP and the remaining system components shown in FIG. 2 may execute on one or more application processors.

The acoustic management module 114 may retain state information between power cycles pertaining to the acoustics of, for example, the vehicle, e.g. learned echo paths and noise estimates. The acoustic management module 114 may correlate the retained state information with additional inputs. For example, the noise estimate may change as a function of RPM. The acoustic management module 114 may provide an improved noise estimate based on the RPM received from the CAN bus. In one embodiment, the acoustic management module 114 may enable the transmit post processing module 108 to derive a better noise estimate with knowledge of what frequencies the engine tones are to be expected.

Figure 3:
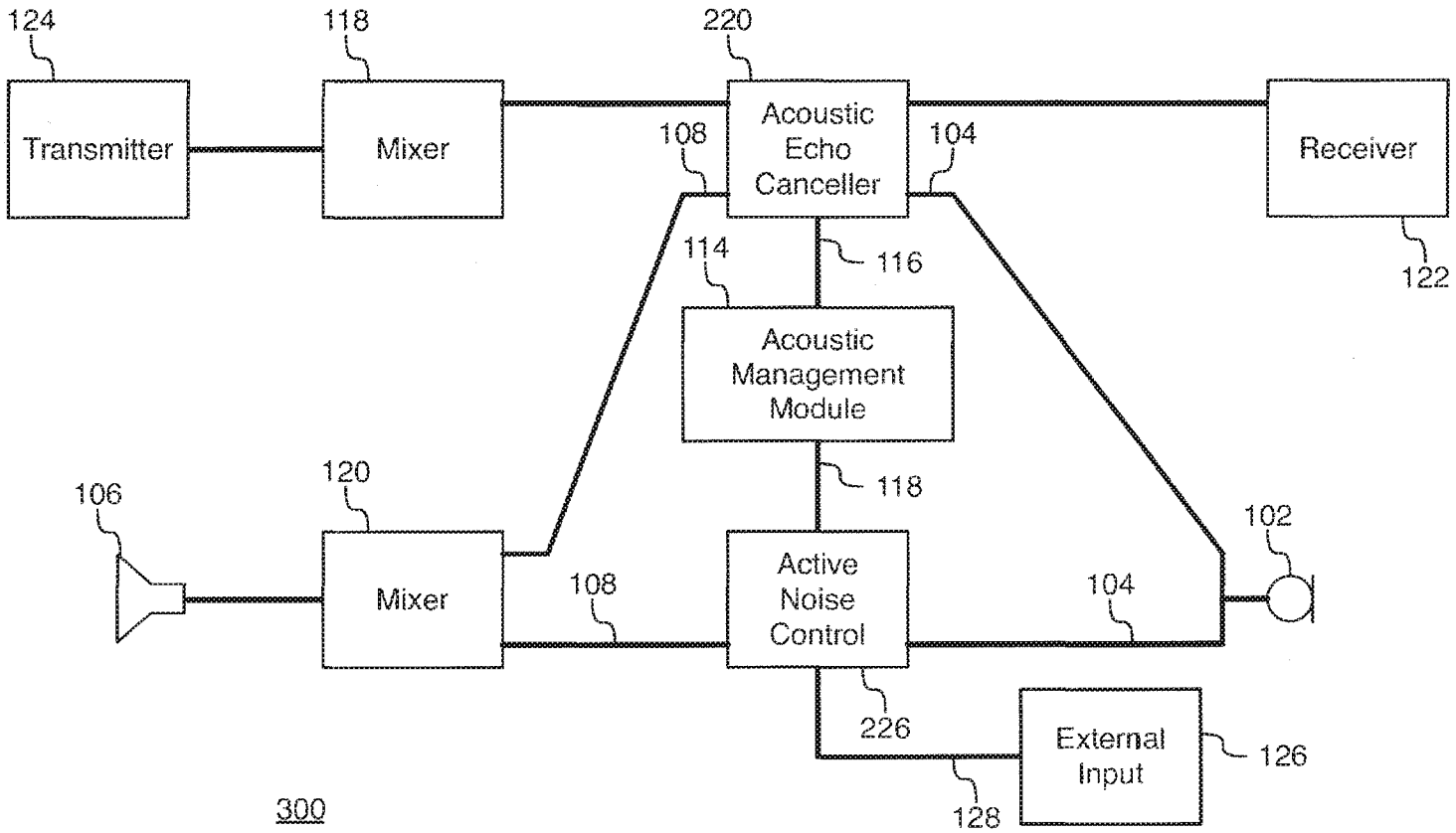
FIG. 3 is a further schematic representation of a system for improving the sound quality of two or more audio processing modules in an acoustic environment.

FIG. 3 through FIG. 6 describe illustrative examples for how the acoustic management module 114 may communicate information to improve performance or robustness when combining two or more audio functionalities compared to a more common architecture where the functions are provided independently. FIG. 3 is a further schematic representation of a system for improving the sound quality of two or more audio processing modules in an acoustic environment 300. The system 300 is an example system where the acoustic echo canceller module 220 and the active noise control module 226 module operate concurrently. Until recently, there has not been much of an issue in the coexistence of voice processing (e.g. hands free or voice recognition) and active noise control since, due to network bandwidth restrictions, acoustic echo cancellation for voice processing had been applied above roughly 200 Hz whereas active noise control in vehicles had been applicable below around 100 Hz. In other words, the AEC module 220 and the ANC module 226 operated in different frequency ranges. However, with the increasing adoption of wideband telephony (50 Hz to 7000 Hz) in cellular networks, and imminent adoption of even wider bandwidths potentially up to full band audio (20 Hz to 20 kHz) using, for example, voice over internet protocol (VoIP) applications in the vehicle, the operational frequency range of the AEC module 220 and the ANC module 226 may now overlap. The AEC module 220 for voice processing estimates the echo path between one or more audio transducers 106 and one or more microphones 102 and attempts to cancel the echo of the far-end talker in the near-end microphone. The ANC module 226 attempts to cancel noise at the position of the microphones 102. Thus, when the ANC module 226 converges towards cancelling frequency components of the far-end talker in the overlapping region, the AEC module 220 may not converge properly. For example, the echo path estimate will tend towards zero leading to echo leakage. The acoustic management module 114 may receive control parameters from the ANC module 226 that may cause the acoustic management module 114 to inform the AEC module 220 to adapt only in specific frequency ranges, or only when the level of the far-end talker in the downlink path is significantly higher than the level of the ANC module 226 output signals.

The ANC module 226 may reduce noise at one or more error sensors, or microphones 102, located near listening positions. Noise reduction may be achieved by internally adapting control filters operating on internal reference signals, to produce the output signals which are sent to the one or more control sources, or audio transducers 106. Disturbances on the microphones 102 unrelated to the noise to be cancelled may potentially result in divergence of the control filters that may result in the ANC module 226 performing sub-optimally or even degrading the sound quality at the listening positions. Unrelated disturbances may include, for example, speech from an occupant of a vehicle and a voice prompt from a navigation system. The acoustic management module 114 may reduce the effect of the unrelated voice disturbances by sending voice presence information to the ANC module 226 from the AEC module 220 when the AEC module 220 includes a voice activity detector (VAD). During voice activity, control filter adaptation could be temporally disabled, preventing divergence and thereby maintaining sound quality.

The ANC module 226 may diverge when the echo paths from the ANC module 220 audio transducers 106 to microphones 102 change significantly, for example, as a result of opening a window, folding a rear-seat, placing baggage in front of a loudspeaker, or installing an after-market loudspeaker or amplifier. Divergence may result in the ANC module 226 actually increasing the noise level in the vehicle cabin rather than decreasing it. Increasing the noise level in the vehicle cabin, or cabin, may be quite distracting for the vehicle occupants. Online secondary path, or echo path identification is well known. Adding a known calibration signal to the control output signals reproduced using the audio transducers 106 and measuring the response at the microphones 102 may be used to determine the online secondary path. However, the calibration signal may be disturbing to the vehicle occupants and may degrade the perceived benefit of the ANC module 226, and thus is not used in practice for vehicle applications. The acoustic management module 114 may communicate the echo path information from the AEC module 220 to the ANC module 226. The ANC module 226 may respond to changes in the echo path information by, for example, temporarily deactivating, initiating a new ANC calibration, or adopting a new echo path estimate. The AEC module 220 or the AFC module 222 may adapt only when signal content is provided over the audio transducers 106 that is not considered disturbing including, for example, music and far-end speech. Alternatively, the ANC module 226 may continually adapt its own internal estimate of echo paths using the reference signal provided to the audio transducers 106 containing music or speech.

Figure 4:
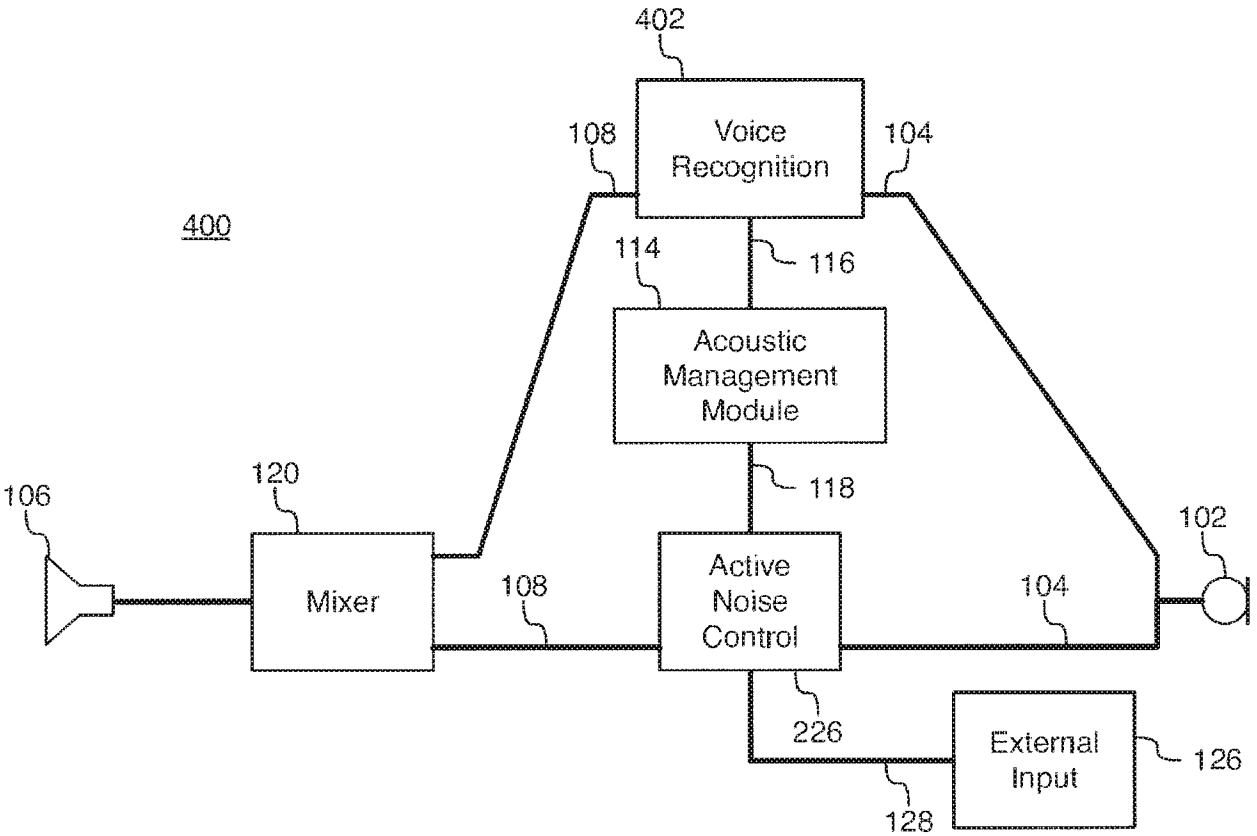
FIG. 4 is a further schematic representation of a system for improving the sound quality of two or more audio processing modules in an acoustic environment.

FIG. 4 is a further schematic representation of a system for improving the sound quality of two or more audio processing modules in an acoustic environment 400. The system 400 is an example system where a voice recognition module 402 and the active noise control module 226 are operated concurrently. Noise within the vehicle may be detrimental to the quality and intelligibility of transmitted speech or performance of a voice recognition (VR) module 402. The acoustic management module 114 may improve the quality and intelligibility by communicating information and control between the ANC module 226 and the VR module 402. The ANC module 226 operating in a voice frequency range, e.g. above approximately 60 Hz, may improve the quality by reducing noise in the acoustic environment captured by the microphones 102 used for hands free (HF) and the VR module 402. The acoustic management module 114 may communicate to the ANC 226 when the HF or the VR module 402 is active. The ANC module 226 may have multiple tuning parameters and be responsive to the acoustic management module 114 where one tuning favors noise reductions at the microphones 102 during a HF phone call or a voice recognition query while at other times using a tuning that favors noise reductions for the occupants of the vehicle.

Multiple tuning parameter settings of the ANC module 226 may be used to optimize the noise reduction at different listening positions in a vehicle to improve over systems where typically only one tuning configuration may be stored. Physical acoustic limitations may necessitate a trade-off of achievable noise reduction between the various listening positions. For example, a candidate tuning A in the ANC module 226 might result in a maximum of 10 dB of noise reduction at the driver's head and 0 dB of noise reduction in the second row, while tuning B might result in a maximum of 6 dB of noise reduction equally at both the driver's head and second row. The acoustic management module 114 may communicate with the ANC module 226 that maintains multiple sets of tuning parameters where the specific tuning parameters may be chosen based on the locations of occupants in the vehicle. The locations of occupants in the vehicle may be determined using control parameters, or information, from the transmit post processing module 208. The location of the occupants may also be determined by, for example, a beam forming calculation or time-direction-of-arrival (TDOA) estimation. The acoustic management module 114 may receive the occupant location information from the transmit post processing 208 and communicate the information to the ANC module 226. A vehicle occupied by only the driver may have the active noise control using tuning A to optimize performance for the drive, whereas tuning B may be used when occupants are in the second row.

Figure 5:
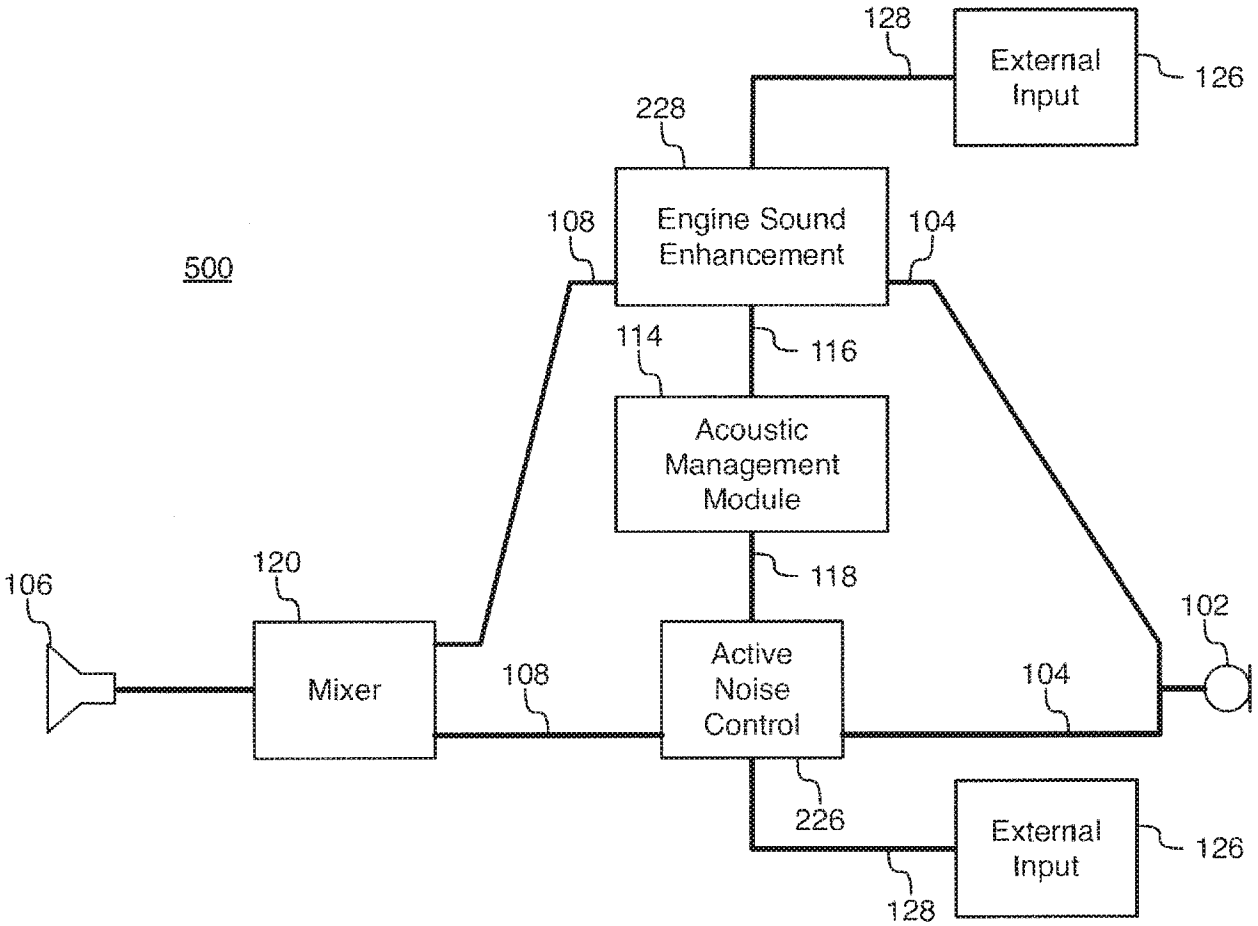
FIG. 5 is a further schematic representation of a system for improving the sound quality of two or more audio processing modules in an acoustic environment.

FIG. 5 is a further schematic representation of a system for improving the sound quality of two or more audio processing modules in an acoustic environment 500. The system 500 is an example system where the engine sound enhancement 228 and the active noise control 226 modules are operated concurrently. In a traditional approach combining active noise control and engine sound enhancement, the ANC module 226 may be targeting engine frequencies that may coincide with frequencies that the ESE 228 is introducing into the cabin. When this occurs, the ANC module 226 may need to output a louder cancelling signal than would otherwise be required if the ESE module 228 were not active. The consequence may be that more acoustic energy than necessary is introduced into the cabin at these frequencies resulting in greater discomfort of the vehicle occupants. Using the acoustic management module 114, the ANC module 226 and the ESE module 228 may communicate information during run-time (i.e. in operation). During the offline design stage of the ESE module 228 profile, the frequencies that the ANC module 226 is targeting may be accounted for by muting these particular frequencies from the ESE module 228 profile, or by filtering them out of the ESE module 228 audio source material. Alternatively, a higher level tuning tool may ask the user to specify the desired level of engine harmonics e.g. as a function of RPM, and automatically translate these into tunings of the ANC module 226 and the ESE module 228 that will ensure mutual compatibility. Alternatively or in addition, a run-time solution may be implemented where adaptive filters may be used to model the transfer functions between the ANC module 226 output signals and the ESE module 228 output signals, and compute error signals which may be, for example, the difference between the ESE module 228 output signals and the convolution of the ANC module 226 outputs with the adaptive filters. In other words, the error signals may contain the ESE module 228 output devoid of any frequencies that the ANC module 226 may be attempting to cancel. The acoustic management system 114 may communicate the information between the ANC module 226 and the ESE module 228.

The NLC module 216 may adaptively amplify audio and voice to be reproduced using audio transducers 106 based on the background noise level in the acoustic environment and other input parameters. One common approach for adaptive playback gain may not utilize an estimate of the background noise levels, but adapts the gain based on the vehicle speed. For example, as the vehicle speed increases it may be assumed that the road noise increases and therefore the loudness of the music should increases. One problem with this approach may be that the background noise level varies by more than 10 dB across different road surfaces, tires, air conditioning noise, and other conditions for any given speed. Thus, such a system may be inappropriately tuned for many driving conditions. Basing the adaptive gain on a background noise estimate may be used to mitigate these issues and, for example, provide a constant SNR of playback level to background noise level. However, a traditional noise estimate may be susceptible to feedback of the playback signal from the audio transducers 106 into the microphones 102 used for estimating the noise level, leading to an ever increasing playback gain. The ever-increasing playback gain may be particularly problematic in music playback where the output signal may be fairly constant in level over time. The acoustic management module 114 may mitigate the issue by using the AEC module 220 to remove the echo from the signal used for background noise estimation in the transmit post processing module 208, so that the noise estimate is based on only the near-end noise sources. Another approach for avoiding the feedback issue is to include the use of accelerometer inputs, e.g. on the wheel suspension, to drive the adaptive gain.

The NLC module 216 may have separate inputs for speech, or "priority" signals, and music, or "non-priority" signals, and apply different gains in order that navigation prompts, far-end speech and chimes are audible above music playback. The acoustic management module 114 may improve the combined audio quality by controlling the NLC module 216 and the mixer 120 to attenuate some non-priority inputs in certain situation, e.g. attenuate the ESE module 228 output during a hands free call. Additionally the acoustic management module 114 may provide the NLC module 216 with an echo path estimate or the near-end noise ratio estimate from any one of the AEC module 220, the AFC module 222 and the transmit post processing module 208. The NLC module 216 may adjust the playback levels for each seating position provided in control parameters from the acoustic management module 114.

Figure 6:
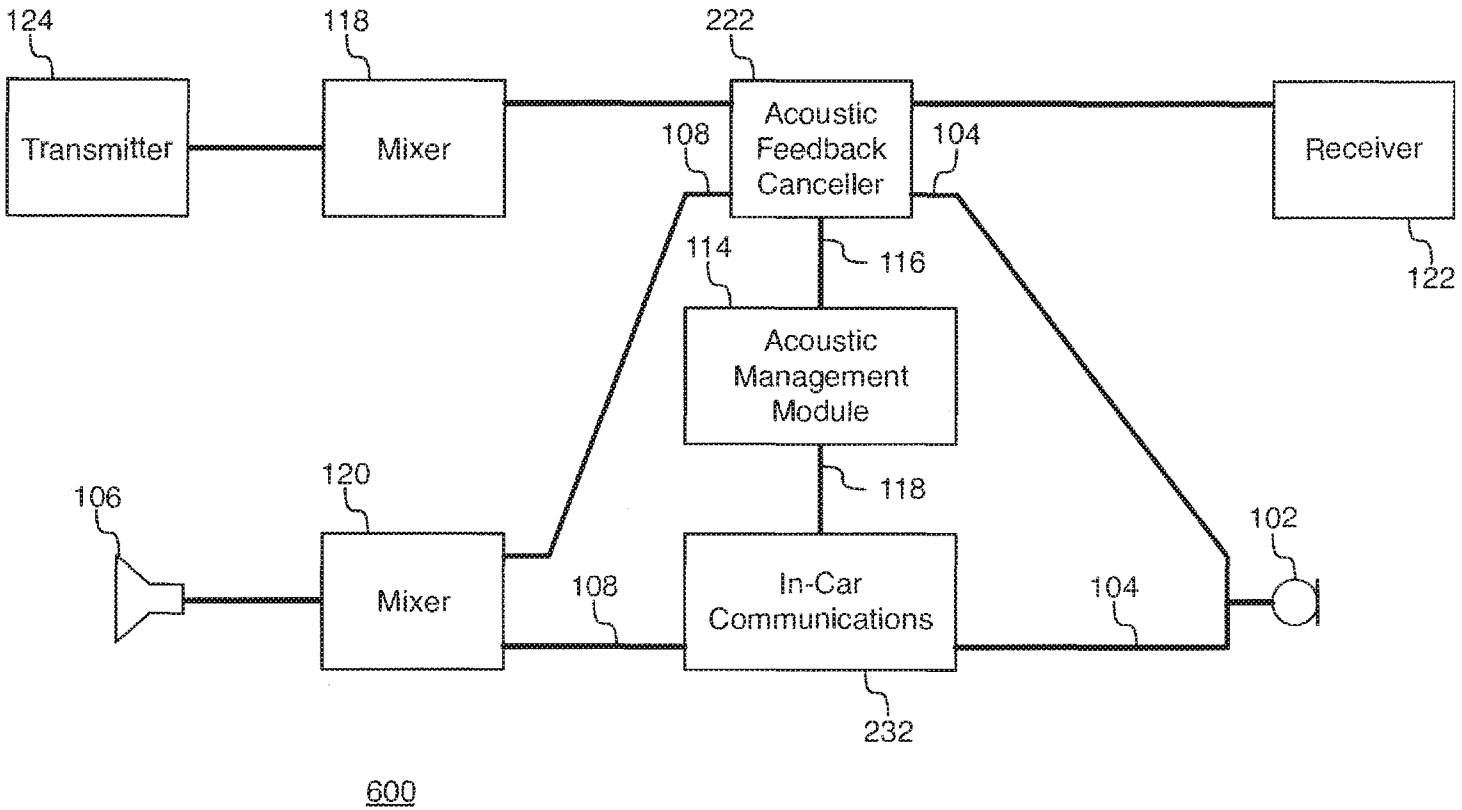
FIG. 6 is a further schematic representation of a system for improving the sound quality of two or more audio processing modules in an acoustic environment.

FIG. 6 is a further schematic representation of a system for improving the sound quality of two or more audio processing modules in an acoustic environment 600. The system 600 is an example system where the acoustic feedback canceller 222 and the in-car communication 232 modules are operated concurrently. ICC facilitates communication between occupants of the vehicle by relaying signals captured by the microphone 102 and reproducing them in the audio transducers 106 within the vehicle. For example, a microphone near the driver's mouth is fed to an audio transducer near the third row to allow third row occupants to hear the driver's voice clearly. Reproducing the drivers voice may result in a feedback path that may cause ringing, so attention must be paid to keep the closed-loop gain at a safe level. Delay and relative level between the direct arrival and reproduced sound of a particular talker at a listener's location is also important to ensure the naturalness of conversation. A state-of-the-art ICC module 232 may use an AFC module 222 to cancel the feedback path. However, near-end noise sources such as road or wind noise may not be distinguishable from talkers. Noise may be picked up by the microphones 102, output from the ICC module 232 loudspeakers, and therefore lead to an increase in noise level in the car. This, in fact, limits the capability of ICC module 232 to improve the SNR of near-end speech over near-end noise. The acoustic management module 114 may cause the ICC 232 to receive one or both of the echo cancelled microphone signals from the AEC module 220 and the AFC module 222 and the transmit post processing module 208 output, the latter of which may contain a noise reduction stage. In this way, the ICC module 232 speech signals sent to the loudspeakers can be devoid of noise (or at least have reduced noise content), allowing an increase in audible speech levels with no or limited increase in near-end noise levels.

Additional acoustic and psychoacoustic modules may be added to the system that execute in conjunction with the acoustic management module 114. The acoustic module may be grouped into the near-end audio processing module 224 where the acoustic module may be responsible for audio classification and diagnosis. The acoustic module may receive from the acoustic management module 114 echo cancelled microphone signals and determine through acoustic feature extraction and classification whether the engine may be performing normally and diagnose any potentially recognized issues with the engine. Audio recordings of an abnormally performing engine may be stored and played back at a later time, for example, when the vehicle is being serviced.

The psychoacoustic module may operate in conjunction with the acoustic management module 114 and the audio processing modules to reduce the amount of acoustic energy introduced into the vehicle that may be imperceptible or that does not contribute to improving audio quality. The psychoacoustic masking module may calculate the frequency and the temporal audio components that a human ear may not perceive at any given time. Adding audio components that may be imperceptible may be undesirable. For example, a user playing music at a very high level may not be able to perceive any of the engine sounds generated using the ESE module 228. The ESE module 228 may be instructed by the acoustic management module 114 to be inactive when the generated engine sounds would be imperceptible. Alternatively, the ESE module 228 may modify the generated engine sounds where a user would be able to perceive the generated sound or increase the gain of the engine sound at high RPM for proper driver feedback.

Figure 7:
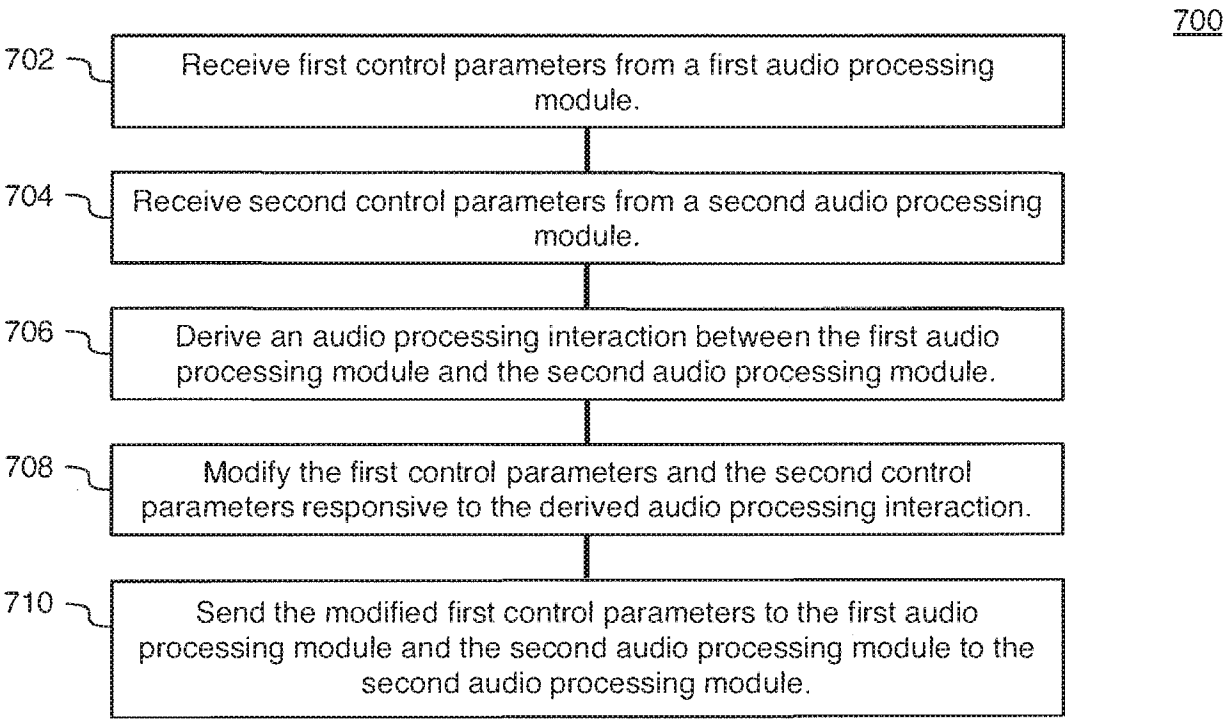
FIG. 7 is a representation of a method for improving the sound quality of two or more audio processing modules in an acoustic environment.

FIG. 7 is a representation of a method for improving the sound quality of two or more audio processing modules in an acoustic environment. The method 700 may be, for example, implemented using the systems 100, 200, 300, 400, 500, 600 and 800 described herein with reference to FIGS. 1, 2, 3, 4, 5, 6 and 8. The method 700 includes the act of receiving first control parameters from a first audio processing module 702. Receiving second control parameters 704 from a second audio processing module. An audio processing interaction may be derived between with the first audio processing module and the second audio processing module determined from the first control parameters and the second control parameters 706. The first control parameters and the second control parameters may be modified responsive to the derived audio processing interaction 708. The modified first control parameters may be sent to the first audio processing module and the modified second control parameters may be sent to the second audio processing module where the first audio processing module and the second audio processing module may perform any one or more of processing audio captured from an acoustic environment and processing audio to be reproduced in the acoustic environment 710.

Figure 8:
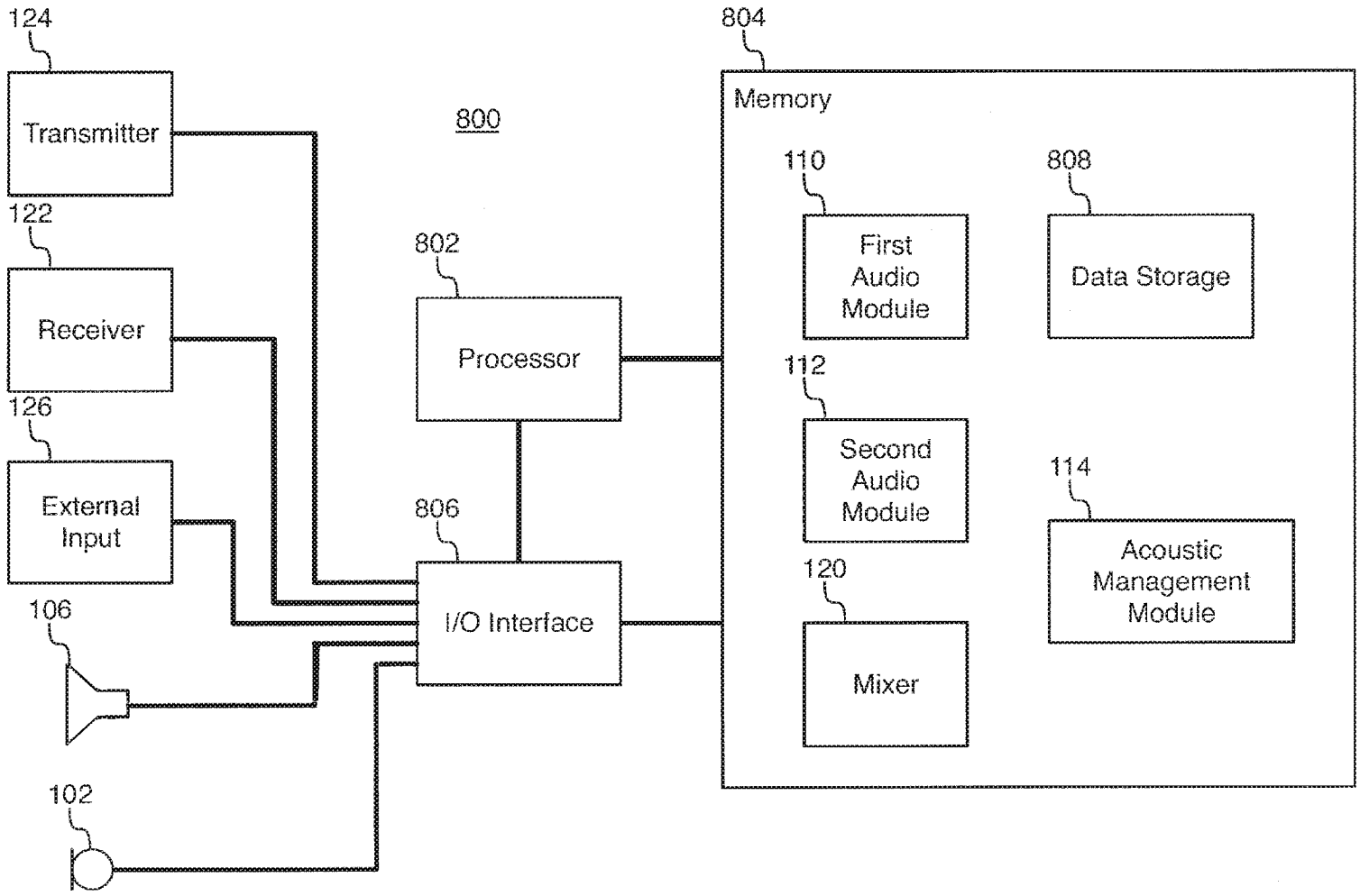
FIG. 8 is a further schematic representation of a system for improving the sound quality of two or more audio processing modules in an acoustic environment.

FIG. 8 is a further schematic representation of a system for improving the sound quality of two or more audio processing modules in an acoustic environment. The system 800 comprises a processor 802, memory 804 (the contents of which are accessible by the processor 802) and an I/O interface 806. The memory 804 may store instructions which when executed using the process 802 may cause the system 800 to render the functionality associated with improving the sound quality of two or more audio processing modules in an acoustic environment as described herein. For example, the memory 804 may store instructions which when executed using the processor 802 may cause the system 800 to render the functionality associated with the first audio module 110, the second audio module 112, the mixer 120 and the acoustic management module 114 as described herein. In addition, data structures, temporary variables and other information may store data in data storage 808.

The processor 802 may comprise a single processor or multiple processors that may be disposed on a single chip, on multiple devices or distributed over more that one system. The processor 802 may be hardware that executes computer executable instructions or computer code embodied in the memory 804 or in other memory to perform one or more features of the system. The processor 802 may include a general purpose processor, a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 804 may comprise a device for storing and retrieving data, processor executable instructions, or any combination thereof. The memory 804 may include non-volatile and/or volatile memory, such as a random access memory (RAM), a read-only memory (ROM), an erasable programmable read-only memory (EPROM), or a flash memory. The memory 804 may comprise a single device or multiple devices that may be disposed on one or more dedicated memory devices or on a processor or other similar device. Alternatively or in addition, the memory 804 may include an optical, magnetic (hard-drive) or any other form of data storage device.

The memory 804 may store computer code, such as the first audio module 110, the second audio module 112, the mixer 120 and the acoustic management module 114 as described herein. The computer code may include instructions executable with the processor 802. The computer code may be written in any computer language, such as C, C++, assembly language, channel program code, and/or any combination of computer languages. The memory 804 may store information in data structures including, for example, panning gains.

The I/O interface 806 may be used to connect devices such as, for example, the one or more microphones 102, the one or more audio transducers 106, the external inputs 126, the receiver 122 and the transmitter 124, and to other components of the system 800.

All of the disclosure, regardless of the particular implementation described, is exemplary in nature, rather than limiting. The system 800 may include more, fewer, or different components than illustrated in FIG. 8. Furthermore, each one of the components of system 800 may include more, fewer, or different elements than is illustrated in FIG. 8. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU.

While various embodiments of the system and method system and method for improving the sound quality of two or more audio processing modules in an acoustic environment have been described, it will be apparent to those of ordinary skill in the art that many more embodiments and implementations are possible within the scope of the present invention. Accordingly, the invention is not to be restricted except in light of the attached claims and their equivalents.

The invention claimed is:

1. A non-transitory machine-readable medium encoded with machine-executable instructions, wherein execution of the machine-executable instructions is for:

receiving first control parameters from a first audio processing module;

receiving second control parameters from a second audio processing module;

deriving an audio processing interaction between with the first audio processing module and the second audio processing module determined from the first control parameters and the second control parameters;

modifying the first control parameters and the second control parameters responsive to the derived audio processing interaction; and sending the modified first control parameters to the first audio processing module and the modified second control parameters to the second audio processing module where the first audio processing module and the second audio processing module performs one or more of processing audio captured from an acoustic environment and processing audio to be reproduced in the acoustic environment.

2. The non-transitory machine-readable medium of claim 1, where the first control parameters are echo control parameters; the first audio processing module comprises an acoustic echo cancellation module; the second control parameters are noise control parameters; and the second audio processing module comprises an active noise control module.

3. The non-transitory machine-readable medium of claim 2, where the modified echo control parameters and the modified noise control parameters instruct the acoustic echo cancellation module and the active noise control module to process non-overlapping frequencies.

4. The non-transitory machine-readable medium of claim 2, where the modified noise control parameters instruct the active noise control module to be responsive to a change in the echo path.

5. The non-transitory machine-readable medium of claim 1, where the first control parameters are voice control parameters; the first audio processing module comprises a voice processing module; the second control parameters are the noise control parameters; and the second audio processing module comprises the active noise control module.

6. The non-transitory machine-readable medium of claim 5, where the modified noise control parameters instruct the active noise control module to be responsive to audio captured from an acoustic environment when voice is not detected in the captured audio.

7. The non-transitory machine-readable medium of claim 5, where the modified noise control parameters instruct the active noise control module to increase noise reduction at a microphone when the voice processing module is active and to increase noise reduction at user locations when the voice processing module is inactive.

8. The non-transitory machine-readable medium of claim 1, where the first control parameters are audio control parameters; the first audio processing module comprises an audio processing module; the second control parameters are the noise control parameters; and the second audio processing module comprises the active noise control module.

9. The non-transitory machine-readable medium of claim 8, where the modified noise control parameters instruct the active noise control module to increase noise reduction at each of one or more user locations.

10. The non-transitory machine-readable medium of claim 1, where the first control parameters are engine sound enhancement control parameters; the first audio processing module comprises an engine sound enhancement module; the second control parameters are the noise control parameters; and the second audio processing module comprises the active noise control module.

11. The non-transitory machine-readable medium of claim 10, where the modified noise control parameters instruct the active noise control module to be responsive to audio components not generated in the engine sound enhancement module.

12. The non-transitory machine-readable medium of claim 1, where the first control parameters are echo control parameters.

13. The non-transitory machine-readable medium of claim 12, where the modified echo control parameters instruct an acoustic echo cancellation module.

14. The non-transitory machine-readable medium of claim 1, where the second control parameters are noise control parameters.

15. The non-transitory machine-readable medium of claim 14, where the modified noise control parameters instruct an active noise control module.

16. The non-transitory machine-readable medium of claim 1, where the first control parameters are echo control parameters and the second control parameters are noise control parameters.

17. The non-transitory machine-readable medium of claim 1, where the first control parameters are voice control parameters.

18. The non-transitory machine-readable medium of claim 1, where the second control parameters are the noise control parameters.

19. The non-transitory machine-readable medium of claim 18, where the modified noise control parameters instruct an active noise control module to respond to audio captured from an acoustic environment.

20. The non-transitory machine-readable medium of claim 18, where the modified noise control parameters instruct an active noise control module to increase noise reduction at one or more user locations.

* * * * *